United States Patent [19]

Varga et al.

[11] Patent Number: 4,803,835

[45] Date of Patent: Feb. 14, 1989

[54] METHOD FOR MODIFYING A YARN

[76] Inventors: Andre Varga, 417 Russell Hill Road, Toronto, Ontario, Canada, M4V 2V3; Harry Cripps, 18 Sunnyfield Road, Heaton Mersey, Stockport, Cheshire, SK4 3HS, England; Paul McHugh, 105 Heatherbrook Rd., Greenville, S.C. 29615

[21] Appl. No.: 31,260

[22] Filed: Mar. 24, 1987

[30] Foreign Application Priority Data

Mar. 25, 1986 [GB] United Kingdom ..... 8607326

[51] Int. Cl.[4] ..... D02G 1/02

[52] U.S. Cl. ..... 57/350; 57/333

[58] Field of Search ..... 57/300, 301, 304, 305, 57/309, 400, 404, 328, 350, 351, 332, 333

[56] References Cited

U.S. PATENT DOCUMENTS

| | | | |
|---|---|---|---|
| 3,296,786 | 1/1967 | Wyatt | 57/309 |
| 3,543,505 | 12/1970 | Stutz | 57/309 X |
| 3,703,075 | 11/1972 | Bose | 57/309 X |
| 4,174,605 | 11/1979 | Pallay | 57/350 X |
| 4,497,168 | 2/1985 | Kamp | 57/400 X |
| 4,700,538 | 10/1987 | Varga et al. | 57/304 X |

*Primary Examiner*—Donald Watkins

*Attorney, Agent, or Firm*—Pasquale A. Razzano

[57] ABSTRACT

A method and apparatus for modifying a spun yarn includes first storage or processing equipment for the yarn, subsequent storage or processing equipment for the yarn spaced some distance from the first storage or processing equipment, a path of travel for the yarn defined between the two sets of equipment, and a false untwister device located along said path of travel for imparting a false untwisting process to the yarn, the yarn subsequently reverting at least partly to the true twist originally present in the yarn, whereby the resulting yarn structure has a very much softer handle than was present prior to the false untwisting step.

6 Claims, 2 Drawing Sheets

METHOD FOR MODIFYING A YARN

This invention relates to a method of, and apparatus for, modifying a spun yarn.

BACKGROUND OF THE INVENTION

The open-end spinning process is now widely practiced. In this process a flow of discrete fibres is fed by an air stream into a rotating spinning chamber and the fibres are deposited on an inner surface of the chamber. From that surface they are picked up by a tail end of yarn which is continuously withdrawn from the top or bottom of the chamber, the action forming a continuous yarn which has a true twist.

Many forms of apparatus are now known for forming the open-end spinning process, but without exception the yarns produced by this process have a very harsh feel, so limiting their end uses. In a number of cases the degree of cleanliness that can be achieved in the yarn also leaves something to be desired.

The open-end spinning process introduces a true twist into the yarn, and the twist can be varied by varying the speed of the drive to the open-end spinning unit. GB-A-1174041 proposes that the twist introduced at the open-end spinning unit can be modified, either increased or reduced, while taking up the yarn from the open end spinning unit and forming it into a package, for example utilising yarn take up means that may be spinning rings and travellers, caps, flyes and the like. This proposal is purely and simply designed to facilitate the production of a yarn with a given degree of twist, and has very little effect on the yarn properties known to be disadvantageous in open-end spun yarn, namely harshness and lack of cleanliness.

These disadvantages do not necessarily exist in other types of spun yarns. Other spinning techniques include traditional ring spinning, jet spinning and friction spinning. Although in some properties any of these may be superior to open-end spun yarns, nevertheless their properties may be capable of enhancement.

The present invention seeks to modify a spun yarn in such a way as to improve the properites of the yarn.

SUMMARY OF THE INVENTION

According to the invention a method of modifying a yarn comprises the steps of driving the yarn along a predetermined path of travel and subjecting the yarn to a false untwisting process during movement of the yarn along said path of travel.

From another aspect the invention comprises apparatus for handling a yarn, the apparatus comprising first storage or processing equipment for the yarn, subsequent storage or processing equipment for the yarn spaced some distance from said first storage or processing equipment, a path of travel for said yarn being defined between the two sets of equipment, and a false untwister device located in said path of travel for imparting false untwist to the yarn.

It is to be emphasized that the invention resides in the step of false untwisting the yarn. The structure of, for example, an open-end yarn is lacking in order compared with that of a ring spun yarn, and the false untwisting does not completely disrupt the open-end yarn structure; the yarn after temporarily untwisting returns substantially to its original structure. Thus, when applied to an open-end spun yarn the invention does not radically modify the degree of real twist that is present in the finished yarn. However, it is suprisingly found that the modification of the yarn structure caused by the false untwisting step give the yarn different and more desirable physical characteristics; in particular, it gives to the yarn a very much softer handle that was present prior to the false untwisting step. Indeed, the softness may be such that it will render the yarn suitable for use in knitwear, an area in which open end spun yarn has not been widely utilized.

With yarns other than those formed by open-end spinning there will be similar untwisting and re-twisting of the yarn and modification of its properties. When working with ring spun yarn, and indeed with other yarns, care must be taken that the false untwisting is not so disruptive as to destroy the yarn completely. This may be difficult with individual yarns, but the false untwisting step is completely feasible when two or more yarns are fed simultaneously through the false untwisting device. The original ordinary twist may then be removed from each yarn, whilst doubling twist would be added to the multi-fold composite structure, and the yarns will stay intact during the processing operation.

Whatever type of spun yarn is treated, the false untwisting operation causes the ejection of an amount of trash particles and so-called microdust, i.e. also performs a cleaning step on the yarn. The cleaning is particularly beneficial when, as preferred, the untwisting action is imparted to the yarn by passing the yarn through a vortex formed in a false untwister device by supplying air under pressure to the device, i.e. when a pneumatic false untwister is used. In this case the ejection of trash particles and microdust is quite violent and a very significant improvement in yarn cleanliness is obtained. This may be enhanced when two or more yarns are treated simultaneously, as inter-yarn friction and abrasion will assist in removing surface particles. Indeed, the improved cleanliness that is obtained may be such as to reduce significantly the wear on apparatus for making fabric from the yarn. For example, when presently available open-end yarn is made up into hosiery it is found that the needles, cams and other parts of the knitting machine wear very quickly, this being accepted as a very serious problem with open-end yarns. By applying a false untwisting step to open-end spun yarn in accordance with the invention this wear can be reduced.

The amount of false untwisting that is applied to the yarn should obviously be such that an enhancement of the yarn properties is obtained; the greater the amount of false-untwist that is applied, the greater is the degree of structural modification of the yarn that is achieved. It is accordingly presently preferred that the amount of false untwisting applied to the yarn is from 20% to 200% (preferably from 50% to 100%) of the true twist that is originally present in the yarn.

The actual time of operating the false untwisting step is not critical. In the context of open-end spinning it may, for example, be carried out immediately downstream of the open-end spinning apparatus just after formation of the yarn, assuming of course that there is a twist barrier, the yarn then passing either direct for further processing or to a storage unit which may be a conventional winding head that will package the final yarn in the form of a cone, cheese or the like. Alternatively, yarn may be packaged in the as-spun state, and the false untwisting operation may be performed on the yarn as it is taken from the package for further processing, for example the false untwisting device may be incorporated into the creel of a knitting machine. In a further alternative the false untwisting operation may be a self-contained step, the as-spun yarn being taken from a first package, passed through a false untwisting device, and then being rewound onto a second package.

DESCRIPTION OF PREFERRED EMBODIMENTS

Figure 1:
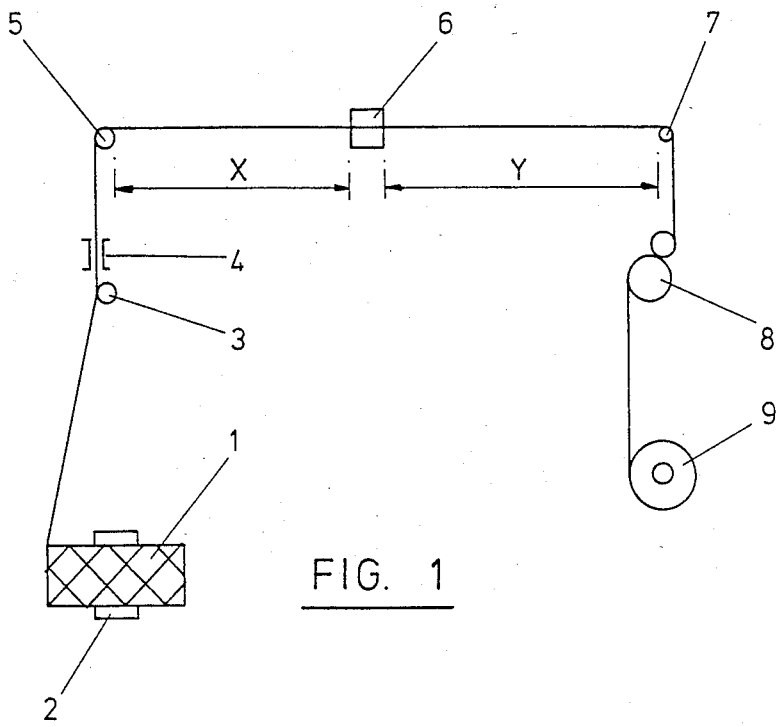
FIG. 1 is a diagramatic illustration of one embodiment of a yarn handling apparatus according to the invention.

Referring to FIG. 1 a package 1 of open-end spun yarn is supported at a supply station 2. Yarn is taken from the package through a yarn guide 3 and tensioner 4 to a further guide 5. From the guide 5 the yarn passes through a false untwister 6 to a further guide 7 from which it is taken by delivery rollers 8 to a take up package 9. The false untwister is desirably of the pneumatic type, although it would also be possible to use a mechanical false untwister.

Thus, in this diagramatic arrangement, the false untwisting operation is a self-contained step, in which the as-spun yarn is taken from a first package, passed through a false untwisting device, and then rewound onto a second package. The false untwisting operation temporarily untwists the true twist originally present in the yarn, but subsequently the yarn reverts substantially to the true twist originally present, but with significantly softer handle than was present prior to the false untwisting step.

Figure 2:
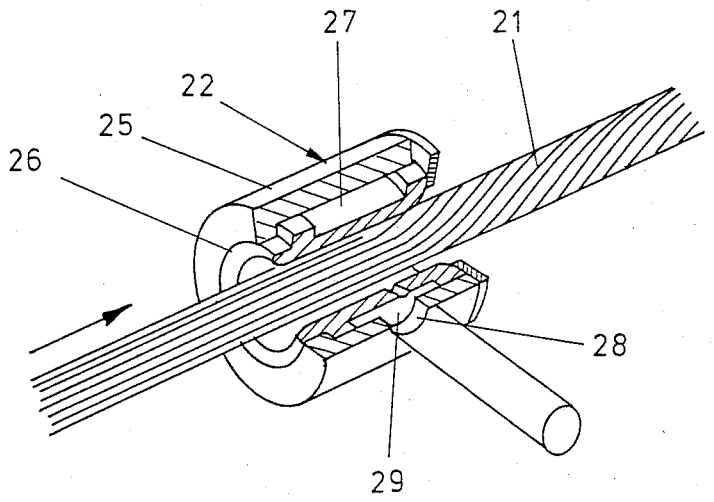
FIG. 2 is a schematic view of a yarn passing through a false untwister device in the apparatus of FIG. 1; and, FIG. 3 is a schematic illustration of two yarns being fed simultaneously to the false untwister device.

FIG. 2 shows yarn 21 passing through a pneumatic false untwist device 22 comprising a jacket 25 within which is mounted a sleeve 26, the jacket and sleeve being shaped so that a plenum chamber 27 is formed between them. A port 28 to which a compressed air line may be connected extends through the jacket 25 to the interior of the plenum chamber. The sleeve 26 is formed with one or more passages 29 leading from the plenum chamber to the interior of the sleeve, the passages each being inclined at an acute angle to the axis of the sleeve. This means that the passages 29 are also each inclined at an angle to the radial plane so that air introduced into the sleeve will have a swirling motion at the axis of the sleeve, and will impart a false untwisting action to the yarn. In the particular case shown in the Figure the real twist is reduced (temporarily) to zero.

The apparatus shown in FIG. 1 has been used experimentally, using a false untwister 4 mm long with a bore of 1.8 mm, the false untwister having five ports inclined at 85° to the axis. Open-end spun yarn was processed through the false untwister at a rate of approximately 1 meter per second, and air was supplied to the false untwister at a rate of approximately 3 liters per minute. Three different grades of open-end spun yarn were processed through the false untwisting device, which effected false untwisting of some 50% to 100% of the true twist originally present in the yarn. In each case the yarn had a softer handle.

In a further test a piece of fabric was knitted from a coarse American-type cotton open-end spun yarn. A second piece of fabric was knitted from the same yarn after this had been subjected to passage through a false untwister as described above. The two pieces of fabric were compared, and that knitted from the yarn that had been subjected to false untwisting was softer to handle than the fabric knitted from the untreated yarn, its stitch clarity was less well defined so giving a gentler fabric, its colour was slightly lighter and there were fewer small pieces of trash attached to its surface. The false untwisting thus significantly improved the final knitted fabric, both in physical characteristics and cleanliness.

The false untwisting process also allows the yarn to be raised more effectively; samples of treated and untreated bleached yarn were introduced as well into a flannelette fabric and as filler yarns into knitted cloth. In both cases the yarns that had been subjected to false untwisting were found, when raised, to give a more uniform and thicker pile.

Figure 3:
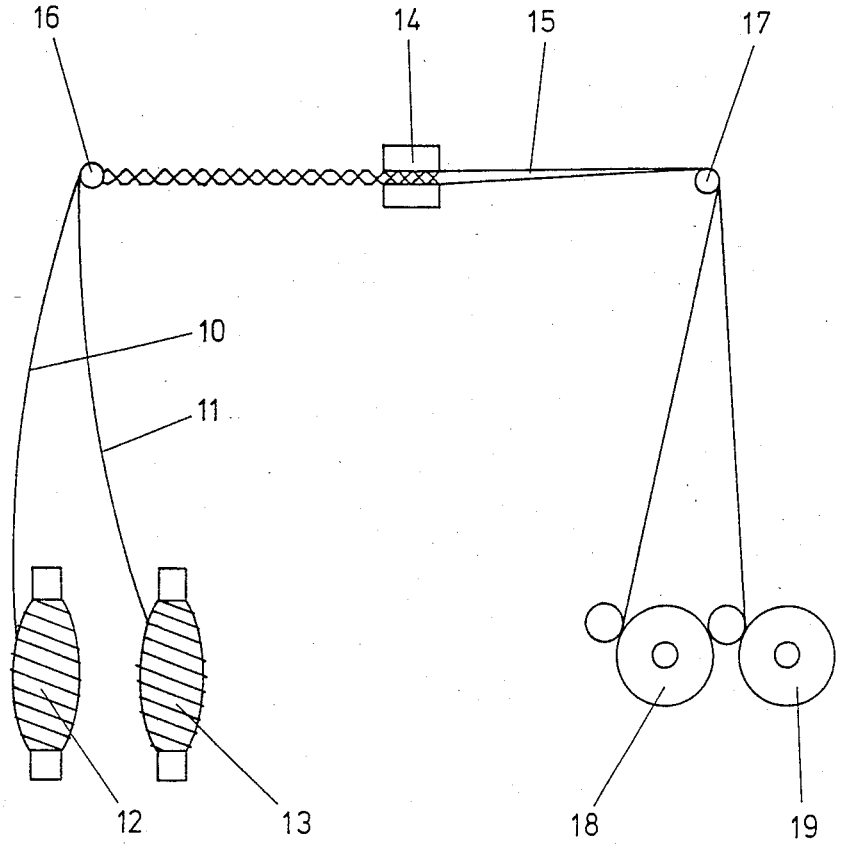

In FIG. 3, there is shown schematically the feeding of two yarns 10 and 11, from respective supplies 12 and 13 in the form of ring tubes or other storage packages, simultaneously to a common false untwister device 14 which exerts such an untwisting action that the original ordinary twist is removed from each yarn, whilst doubling twist is added to the resulting multi-fold composite structure 15, and yarns will stay intact during the processing operation.

The invention will now be understood in broad principle. For any given yarn the optimum parameters for untwisting may readily be determined empirically, and it is thought that the false untwisting effect may be dependent on such factors as tension in the untwisting zone, yarn overfeed, yarn speed and compressed air usage and the distance (x) of the false untwisting device (6) from the upstream guide (5). It is believed that the smaller is the distance x, the more efficient may be the false untwisting process. The yarns 10 and 11 pass to an upstream guide (or delivery rollers) 16 and then to the false untwister 14, and via a downstream guide (or delivery rollers) 17 to respective take-up packages 18,19. Design of the actual false twisting device will also play a part, and there are many forms which such device may take.

We claim:

1. A method of modifying a spun yarn composed of a highly twisted strand of fibers, comprising the steps of driving the originally twisted spun yarn along a predetermined path of travel, subjecting the spun yarn to a false untwisting process during movement of the spun yarn along said path of travel, and then causing or allowing the spun yarn to revert at least partly to the true twist originally present in the spun yarn.

2. A method according to claim 1, in which the false untwisting process is a pneumatic false untwisting process so as to eject trash particles in order to carry out a cleaning step on the yarn.

3. A method according to claim 2, in which the pneumatic false untwisting process includes passing the yarn through a vortex formed in a false untwister device by supplying air under pressure to said device.

4. A method according to claim 3, in which at least two yarns are treated simultaneously so as to remain intact and whereby inter-yarn friction and abrasion assist in removing surface particles.

5. A method according to claim 1, in which the yarn is an open-end spun yarn.

6. A method according to claim 1, in which the yarn is a ring spun yarn, jet spun yarn, or friction spun yarn.

* * * * *